United States Patent [19]

Mallari

[11] Patent Number: 4,919,793

[45] Date of Patent: Apr. 24, 1990

[54] PROCESS FOR IMPROVING PRODUCTS' QUALITY AND YIELDS FROM DELAYED COKING

[76] Inventor: Renato M. Mallari, 6403 Teal Run Dr., Houston, Tex. 77035

[21] Appl. No.: 232,761

[22] Filed: Aug. 15, 1988

[51] Int. Cl.[5] ..... C10G 9/14

[52] U.S. Cl. ..... 208/131; 208/48 R; 208/132

[58] Field of Search ..... 208/50, 56, 57, 131, 208/48 R, 132

[56] References Cited

U.S. PATENT DOCUMENTS

| | | | |
|---|---|---|---|
| 1,903,717 | 6/1934 | Rittmeister | 208/48 R |
| 2,963,416 | 12/1980 | Ward et al. | 208/50 |
| 3,684,688 | 8/1972 | Roselius | 208/50 |
| 3,817,853 | 6/1974 | Folkins | 208/50 |
| 4,312,742 | 1/1982 | Hayashi | 208/50 |
| 4,358,366 | 11/1982 | Alford et al. | 208/112 |
| 4,385,982 | 5/1983 | Anderson | 208/50 |
| 4,394,250 | 7/1903 | Grassberg | 208/131 X |
| 4,455,219 | 6/1984 | Janssen et al. | 208/131 |
| 4,459,934 | 10/1985 | Graf et al. | 208/131 |
| 4,518,487 | 5/1985 | Graf et al. | 208/131 |
| 4,604,186 | 8/1986 | Lutz et al. | 208/50 |
| 4,661,241 | 4/1987 | Dabkowski et al. | 208/56 X |

OTHER PUBLICATIONS

Oil and Gas Journal, "Delayed Cokins is Topic of Experience Exchange", Jul. 27, 1987, pp. 51–56.

*Primary Examiner*—Glenn Caldarola

[57] ABSTRACT

This invention is an improvement of the prior art in that the properties, as well as the molecular structure of the coker heater charge material are altered by hydrogeneration under conidtions of pressure and temperature typically operated for a conventional delayed coking process. Hydrogeneation of the heater charge material is accomplished in a soaking pipe provided with static mixers for up to 90 minutes fluid residence time thereby improving the quality and yields of products from the process.

5 Claims, 2 Drawing Sheets

PROCESS FOR IMPROVING PRODUCTS' QUALITY AND YIELDS FROM DELAYED COKING

BACKGROUND OF THE INVENTION

1. Field of the Invention

This invention relates to a method of improving the quality and yields of products from a delayed coking process.

2. Description of the Prior Art

The fundamental reactions involved in a delayed coking process are thermal cracking and polymerization of petroleum residues under conditions of pressure, temperature, and time. The process produces green coke, hydrocarbons and gases—the quality and quantity of which are mainly dependent upon the type and quality of the fresh feed charged into the unit. During operation, this fresh feed is rapidly heated in a coker heater above its cracking temperature, or approximately 920° F., within 5 minutes. Its effluent is then transferred into a large soaking vessel called a coke drum which allows the reactions to proceed for approximately 24 hours.

For obvious economic reasons, it has been the objective of a refinery, and the subject of many inventions, to increase the yield of hydrocarbons and to lower the yield of less valuable green coke. The gas yield meanwhile attains a narrow and economically insignificant range which is virtually unchanged over a given set of operating conditions in the coke drum and therefore, is given less attention in the unit. Hydrocarbons yield enhancement is specially emphasized for stocks producing fuel grade and aluminum anode grade cokes. For premium or needle cokes, the emphasis is mostly on improved end-user coke properties such as lower coefficient of thermal expansion (CTE), higher mechanical strenght and higher electrical conductivity. For any given coker fresh feed, and any given set of operating conditions, a refiner has limited control of improving green coke quality while optimizing product yields. Among many of the most recent inventions in yield optimization are U.S. Pat. Nos. 4,455,219, 4,518,487, 4,549,934, and 4,604,186. The former first three patents emphasize partial or complete removal of the natural heavy recycle oil from the coker heater charge while the latter fourth patent teaches the blending of hydrogen donor hydrocarbons to the coker fresh feed.

The availability of heavy and low quality coker fresh feeds have given rise to the production of fuel grade green cokes which are spherical in shape. Its size may vary from a sand particle to buck shots, and invariably, up to a size as large as a basketball. It is called "shot coke" in the industry and considered undesirable, though normally tolerated, during operation. Shot coke formation tends to produce less hydrocarbons and more green coke. A more detailed discussion on the commercial significance of shot coke and its ramifications is reported in the Oil & Gas Journal, July 27, 1987, pages 51–56, "Delayed coking is topic of experience exchange".

Constituents of heavy petroleum residues typically consist of asphaltenes, resins and heavy oil. The latter is medium aromatics of approximately 2 to 4 benzene rings, 0 to 2 naphthene rings and cycloparaffins, and some attached alkyl substituents. Resins has more benzene rings and alkyl substituents than heavy oil, but asphaltenes has the most benzene rings, understably the heaviest, and the constituent where most of the green coke yield is derived. Clusters of aromatic rings of various sizes in any of these constituents may be connected by aryl and alkyl bridges which separates when thermally cracked Recombination of cracked aromatic clusters is possible, and in fact may become a precursor compound for production of more coke-forming materials. Growth of said clusters may be averted by combining with hydrogen radicals that is available in the reacting medium—commonly referred to as hydrogen capping or hydrogen stabilization. Most of the hydrogen atoms is produced by polymerization via dehydrogenation of aromatic compounds, but supplements of hydrogen radicals are also produced from thermal cracking of other hydrocarbons, e.g., naphthenes, olefins, paraffins, etc. Thus, a coker fresh feed with low hydrogen/carbon atom ratio produces more green coke and less hydrocarbons products. Current delayed coking operation has no control of increasing the hydrogen radicals except by charging the unit with lighter stocks of high hydrogen to carbon ratio or, in the case of U.S. Pat. Nos. 4,385,982 and 4,604,186 for example, a suitable hydrogen donor hydrocarbon is added into the process.

Impurities in the fresh feed residue such as metals, sulfur, and other heteroatoms are transferred into the products. Weakly bonded sulfur decompose and recombine with hydrogen radicals producing hydrogen sulfide gas. More thermally stable heteroatoms, that is, those atoms deeply imbedded in the mostly aromatic molecular structure of the fresh feed, go through heat treatment in the coke drum without decomposing and hence become part of the newly formed green coke and hydrocarbons products. Current delayed coking operation has limited control of reducing these impurities except by charging the unit with a coker stock of lesser heteroatoms content. The use of catalytic hydrogenation of coker stocks to remove some of these impurities are disclosed in U.S. Pat. Nos. 2,963,416 and 3,817,853.

Direct catalytic hydrogenation of the coker fresh feed to reduce the green coke yield and improve the hydrocarbons yield is disclosed in U.S. Pat. Nos. 3,684,688, 4,358,366 and 4,394,250. Hayashi disclosed in U.S. Pat. No. 4,312,742 a direct non-catalytic hydrogenation for improving green coke quality and for the removal of oxygen-, sulfur-, and nitrogen-containing impurities from the coker feedstock. The process of Hayashi consists of gradually heating the fresh feed, admixed with hydrogen gas, from approximately 300° F. up to 752° F. in furnace tubes within 30 to 180 minutes. The residue thus hydrotreated is transferred into a settling tank where the precipitated converted asphaltenes, other insolubles, and the unreacted hydrogen gas and inert gases, are separated from the clarified residue oil which is fed into a conventional coker heater and hence, into a conventional coke drum for delayed coking. It is emphasized that Hayashi has not disclosed and teached the embodiments involved in hydrogenation without gradually heating the coker fresh feed and without using a settling tank. Hayashi's use of the furnace heating tubes and a settling tank are essential to the removal of impurities from the fresh feed and consequently, to subsequent improvement of coke quality in the coke drum.

In aforementioned U.S. Pat. No. 3,817,853, Folkins disclosed the improvement in coke CTE and hydrocarbons yield by the catalytic hydrogenation of the coker fresh feed. Folkins further mentioned non-catalytic hydrogenation, but has not disclosed any embodiment whatsoever, as fittingly mentioned by Hayashi in aforementioned U.S. Pat. No. 4,312,742.

SUMMARY OF THE INVENTION

According to the present invention, the process of prior art delayed coking is modified by non-catalytic hydrogenation of the heater charge material in a soaking pipe with or without any diluent, with or without the natural heavy recycle oil, and with or without the catalytic cracker decant oil, under conditions of conventional pressure and temperature typically operated for the unit. The soaking pipe upstream of the conventional coker heater is provided with a fluid residence time of 10 to 90 minutes depending on the required hydrogen gas absorption which in turn, can be reduced by blending the coker fresh feed with catalytic cracker decant oil. The objectives of this invention are to reduce the green coke yield, increase the hydrocarbons yield, minimize the formation of shot coke, improve the coke CTE and electrical conductivity, improve the gaseous products distribution and improve the quality of liquid hydrocarbons for the case of an operation involving the use of vacuum distillation residues producing fuel grade and aluminum anode grade green cokes For the case of manufacturing premium or needle coke from highly aromatic coker fresh feeds, the objective is to reduce the coke CTE, increase its electrical conductivity, and increase its mechanical strength. In essence, this invention improves the quality and yields of products from a conventional delayed coking process.

DETAILED DESCRIPTION OF THE PRIOR ART PROCESS

Figure 1:
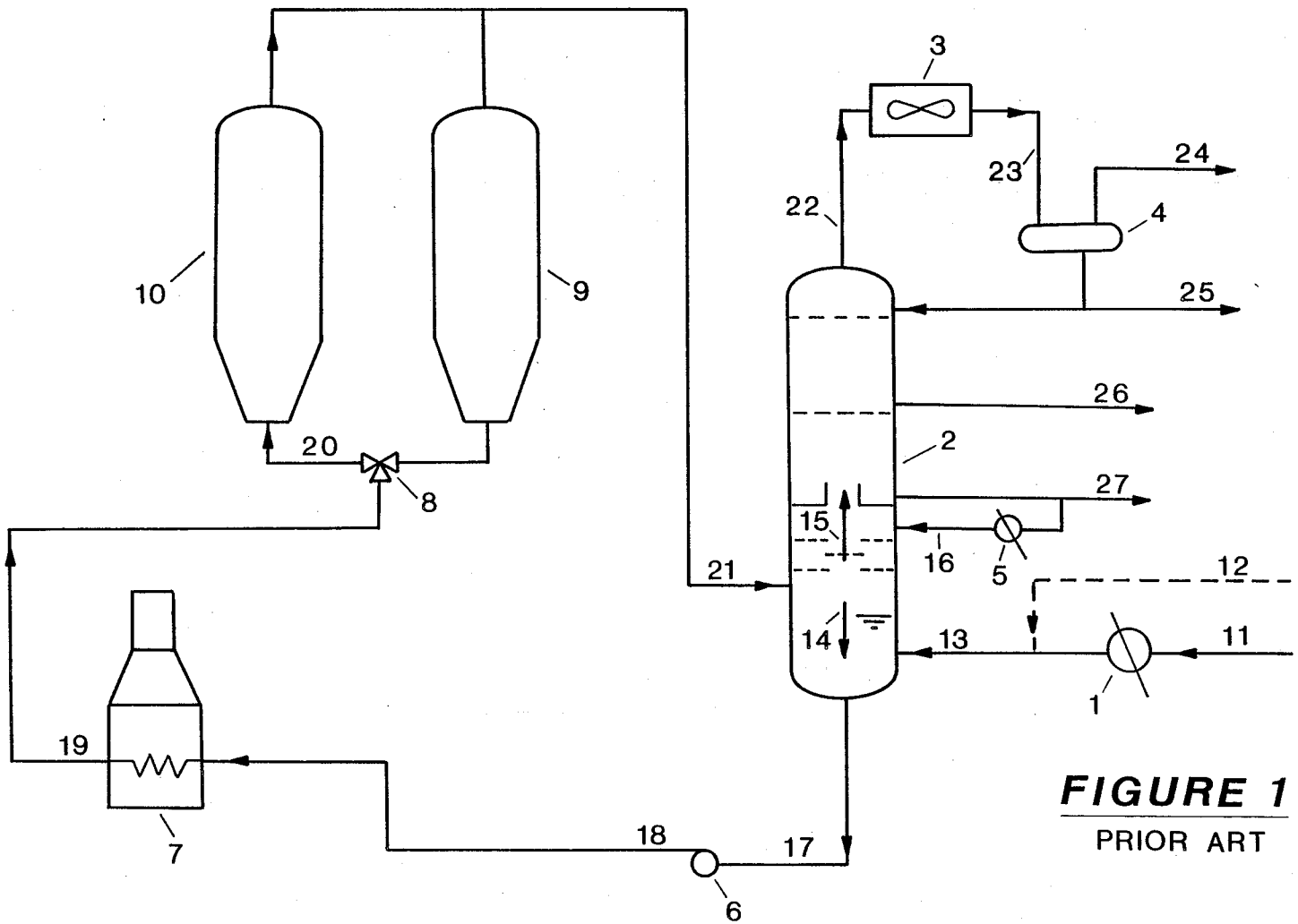
FIGURE 1 PRIOR ART
In FIG. 1 is a schematic flow diagram showing the PRIOR ART delayed coking process.

A prior art delayed coking process currently practiced in the industry is illustrated in FIG. 1. The coker fresh feed from line 11, consisting primarily of petroleum hydrocarbon derivatives from various refining processes, e.g., vacuum distillation residue oil, catalytic cracker decant oil, thermal tar residue, coal tar residue, ethylene tar residue, shale oil residue, asphalt, heavy fuel oil, tar sand bitumen and the like, or combination thereof, is preheated in a series of heat exchangers represented by exchanger 1. The fresh feed may also have been preheated from the process units where it originated. In this case, previously preheated fresh feed 12 bypasses exchanger 1. Nonetheless, coker fresh feed from line 13 enters the bottom of fractionator 2 at a temperature range of 400°-600° F.

In the primary bottom section of fractionator 2 consisting of the heavy gas oil draw-off tray, shed decks, and fractionator liquid bottoms accumulator directly below the shed decks, the natural heavy recycle oil represented by stream 14 is separated from the coke drum overhead vapor 21 and then combines with the coker fresh feed 13 in fractionator 2 liquid bottoms accumulator. The combined natural heavy recycle oil stream 14 and coker fresh feed 13, commonly referred to as the coker heater charge material, at approximately 420°-620° F., is withdrawn from fractionator 2 liquid bottoms accumulator via line 17. It is then pressured at approximately 350 to 550 psig by heater charge pump 6 into line 18 through the heating tubes of coker heater 7.

In the most recent development of prior art delayed coking process, refineries sought reduction of green coke yield by minimizing the natural heavy recycle oil stream 14 as part of the heater charge material and partially replacing it with light gas oil. The light gas oil used in this configuration is a portion of the light distillate product from line 26 that is admixed with the coker fresh feed 11 or 12. The coker heater charge material in this configuration therefore, consists of the combination of the coker fresh feed, recycled light gas oil, and natural heavy recycle oil.

In another development of the prior art, the natural heavy recycle oil stream 14 from fractionator 2 liquid bottoms accumulator is pumped to another refinery process unit. The coker fresh feed combines with the recycled light gas oil and the combination thereof is heated and pumped through the coils of the coker heater. The heater charge material in this configuration therefore, consists only of the heated fresh feed and the recycled light gas oil—that is, without the natural heavy recycle oil.

There are other configurations in prior art delayed coking involving the elimination of the natural heavy recycle oil, but it is clear and accepted by those who practice the art that the coker heater charge material consists primarily of the coker fresh feed. For clarity therefore, the coker heater charge material consisting of the coker fresh feed, with or without the natural heavy recycle oil, with or without the recycled light gas oil, and with or without any diluents, from fractionator 2 liquid bottoms accumulator as represented by line 18, or directly from the coker fresh feed line 13 for the case of aforementioned configuration where the natural heavy recycled oil or stream 14 is pumped to another unit, is referred to hereinafter as the "coker heater charge" material.

The coker heater effluent of approximately 920° F. from line 19 is fed to coke drum 10 wherein the green coke produced is allowed to accumulate within a coking cycle of approximately 24 hours. After this cycle time, coking operation is switched to coke drum 9 through a three-way valve 8 and the previously filled drum 10 is emptied of its accumulated green coke. Produced from coke drum 9 or 10 is an overhead vapor transferred to fractionator 2 via line 21. This coke drum overhead vapor product in essence is the net fractionator 2 products in combination with the natural heavy recycle oil, or stream 14.

The net fractionator 2 products consist of gases, i.e, $H_2$, $H_2S$, CO, $H_2O$, etc; light hydrocarbons vapor, or methane to butanes; and hydrocarbons consisting of pentanes to heavy gas oil fraction with a TBP end cut point of approximately 800° F. The refined or distilled products separated in fractionator 2 are represented by stream numbers 27 (heavy gas oil), 26 (light gas oil), 25 (unstabilized naphtha), and 24 (fractionator overhead vapors). The natural heavy recycle oil, or stream 14, is a hydrocarbons fraction of the coke drum overhead vapor product heavier than the heavy gas oil fraction with a TBP initial cut point of 800° F. and TBP end point of approximately 1,000° F. The natural heavy recycle oil is considered to have medium aromatics in its molecular structure as typically represented by its properties, e.g., 8.7° API, 11.0 UOP K, and 15 cks viscosity at 210° F. It should be noted that the TBP cut point at 800° F. between the heavy gas oil fraction and natural heavy recycle oil fraction is controlled in the shed decks of fractionator 2 primary bottom section. This cut point in turn, controls the flow rate and properties of the natural heavy recycle oil.

The nozzle of line 21 connected to fractionator 2 is positioned between the shed decks and the maximum liquid level of the liquid bottoms accumulator in fractionator 2. This positioning enables the hot vapor from line 21 at about 820° F. be cooled by the cascading liquid of heavy gas oil pumparound return from exchanger 5 via line 16. This cooling process occuring in the shed decks condenses the natural heavy recycle oil stream 14 which then combines with the coker fresh feed from line 13, or otherwise pumped out to other refinery units without combining with the coker fresh feed.

Emanating from the shed decks is stream 15, the net vapor fractionator 2 products in combination with the vaporized heavy gas oil pumparound. The first draw-off tray above the shed decks is heavy gas oil (HGO) product along with the HGO pumparound liquid. The HGO product fraction with a boiling range of about 600° F. to 900° F. TBP is pumped to other units in the refinery via line 27 while the HGO pumparound liquid is returned and cooled in exchanger 5 and then distributed into the shed decks of fractionator 2 via line 16.

The second draw-off tray above the HGO draw-off tray is product light gas oil (LGO) fraction with a boiling range of about 270° F. to 690° F. TBP and pumped to other units in the refinery via line 26. This fraction is used in the aforementioned latest configurations of the prior art to partially, or totally, replace the natural heavy recycle oil.

Overhead vapors from line 22 of fractionator 2 is cooled in aircooler 3 and the condensed liquid light hydrocarbons, commonly known as unstabilized naphtha with a boiling range up to approximately 420° F. TBP, is separated from the fractionator overhead vapor product 24 in accumulator drum 4. Vapors from line 24 is transferred to other units in the refinery for recovery of light hydrocarbons. A major portion of the unstabilized naphtha is refluxed to the top tray of fractionator 2 while the net product unstabilized naphtha from line 25 is pumped to other units in the refinery for further fractionation or processing.

Coke quality is well known to practitioners of the art as largely feedstock-related. For example, vacuum distillation residue oil from various blends of crude stocks with high heteroatoms such as sulfur, oxygen, nitrogen, vanadium, sodium and the like, and particularly coker feeds with high asphaltenes content produce green coke with properties suitable only for fuel use. This coke is therefore referred to as fuel grade coke. Green cokes produced from crude stocks with relatively lower heteroatoms, lower asphaltenes contents, and higher aromatics content, are normally suitable as a raw material for the manufacture of electrolytic aluminum anodes. This green coke, invariably referred to as regular or anode grade coke, is known to impart high electrical conductivity in aluminum electrolytic anodes, but its mechanical strength is not emphasized. Thermally processed coker fresh feeds such as, decant oil from a catalytic cracker unit, thermal tar residue from a thermal cracking unit, ethylene tar residue from an ethylene synthesis unit, and others which are known to have high aromatic content, little or no heteroatoms, and little or no asphaltenes content, are used to produce the so-called premium or needle coke. Graphitized electrolytic anode produced from premium green coke, suitable for the manufacture of steel, has lower coefficient of thermal expansion (CTE), greater strength and higher electrical conductivity than anode grade coke.

With the proliferation of heavy crude stocks mainly characterized by its high heteroatoms, very high asphaltenes content, and little or no aromatics content, a large number of refineries have been producing green cokes from vacuum residue oil which are hard and spherical in physical appearance. This type of green coke produced in prior art delayed coking units is commonly referred to as "shot coke"—a term derived from its physical appearance resembling a buck shot. Shot coke, sold for fuel grade coke, is undesirably produced in commercial delayed coking units, but its anomaly appears to have been the inability of prior art delayed coking process to economically minimize its formation in the coke drum.

While shot coke is accomodated in coking operations, the main difficulty expressed in the industry is the failure of prior art delayed coking process to reduce the green coke yield and improve the hydrocarbons yield while minimizing or avoiding the formation of shot coke. Practitioners in the art have concluded that these desirable objectives can not be accomplished simultaneously.

Highly aromatic diluents such a the catalytic cracker decant oil when blended with vacuum distillation residue oil, are found to be effective in avoiding shot coke. However, at an effective blending rate of 5 to 15 volume %, and without the added incentive of improving the hydrocarbons yield, this mode of operation is not practiced in the industry.

For obvious economic reasons therefore, refiners have been allowing the formation of shot coke while increasing the hydrocarbons yield by one or combination of the following: (1), high coker heater effluent temperature; (2), low coke drum overhead pressure; and (3), partial or total replacement of the natural heavy recycle oil with recycled light gas oil.

An improvement in prior art delayed coking process has now been discovered and is hereby disclosed in the following Description of the Preferred Embodiment whereby aforementioned items (1), (2), and (3) can now be practiced to improve the hydrocarbons yield and reduce the green coke yield while simultaneously minimizing or avoiding shot coke formation. These objectives are accomplished by hydrogenating the coker heater charge material under conditions of pressure and temperature already existing in the prior art. Blending with decant oil at a lower rate than the prior art, or approximately 0.5 to 4.4 volume %, also reduces shot coke formation, but its use is an operational decision based on other considerations as discussed hereunder. Improvements in coke quality, hydrocarbons properties and gas distribution are also inherently accomplished. The present invention therefore is a process for improving the products' quality and yields from delayed coking.

DESCRIPTION OF THE PREFERRED EMBODIMENT

Figure 2:
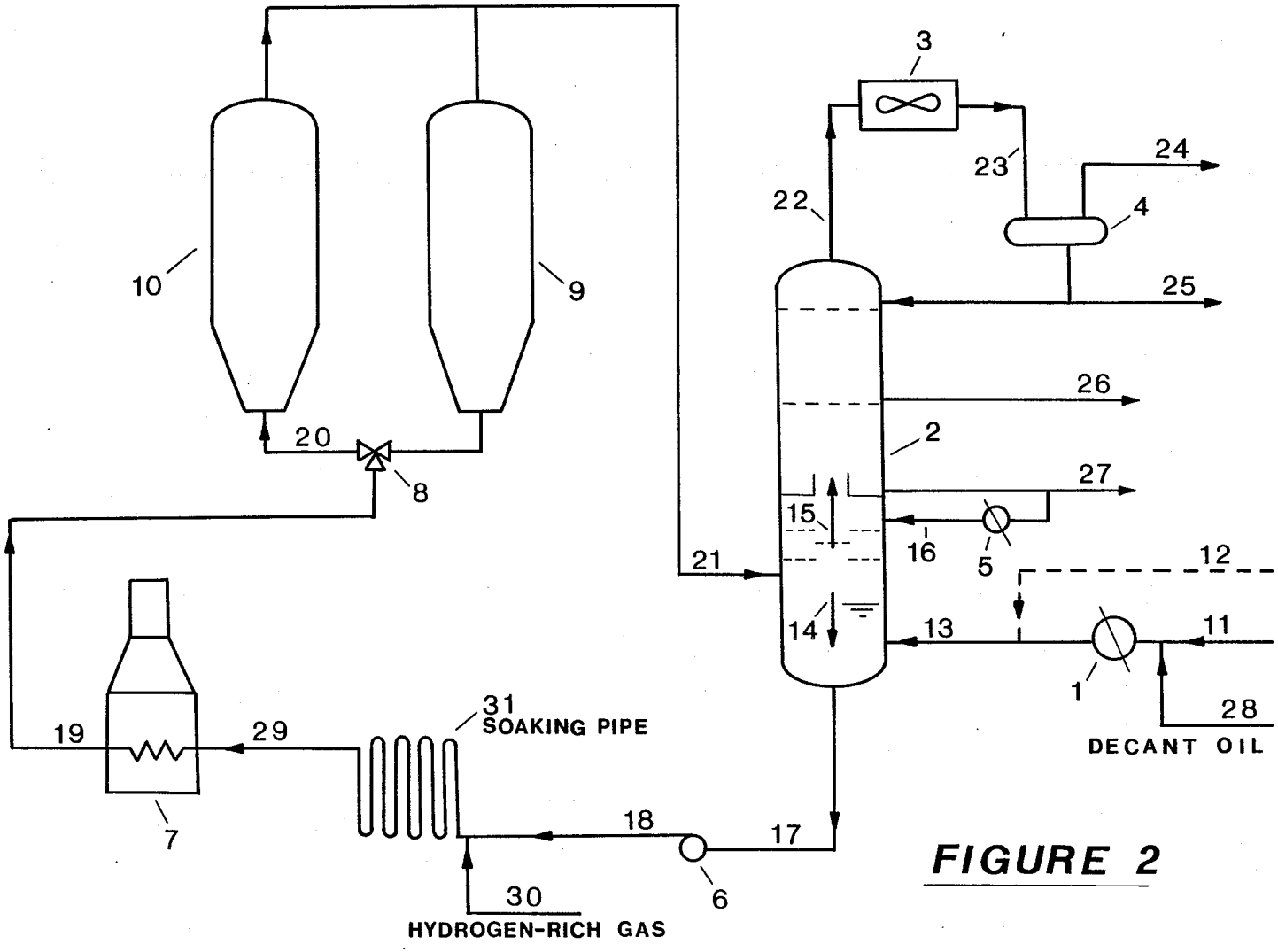
In FIG. 2 is a designated drawing illustrating the preferred embodiment of the process of this invention.

FIG. 2 is a schematic flow diagram of a representative embodiment of this invention where like numbers 1 through 27 are designated for items which are also common in FIG. 1. Additional numbers 28 through 31 are specifically assigned for FIG. 2 designating those items representing the aforementioned improvement for this invention.

Blending of catalytic cracker decant oil with vacuum distilled residue oil at lesser rates than the prior art in order to substantially reduce shot coke production, is possible only with hydrogenation. Decant oil alone does not reduce the green coke yield, nor does it improve the hydrocarbons yield, but it is particularly useful in the coker heater charge material since it acts as a good solvent for the proper operation of the heater. Decant oil in this invention is used to further reduce shot coke production for the same hydrogen consumption. But it is emphasized that decant oil is not required if the green coke has acceptable quality when using the same fluid residence time and hydrogen consumption for yield improvement.

Referring now to FIG. 2, decant oil from line 28 may, and may not be blended to the coker fresh feed lines 11 or 12. The blending rate for reducing shot coke production varies from 0.5 to 4.4 volume % of the coker fresh feed rate, depending on aforementioned economic considerations.

For an operating case where the coker unit is dedicated to producing needle coke (i.e., the unit is exclusively bringing in from line 11 premium fresh feeds such as catalytic decant oil, thermal tar residue, coal tar residue, ethylene tar residue, shale oil, and combination thereof), it is now possible in this process to blend low quality feedstocks such as reduced crudes, or vacuum residue oil with low sulfur and metals content with said premium stocks and produce cokes of comparable or acceptable properties as the ones produced from pure premium stocks. This is otherwise not possible, or uneconomical, or the coke quality produced is unpredictable, in prior art delayed coking process. Hydrogenation in a soaking pipe as defined herein in this specification therefore, improves coke quality from poor quality fresh feeds consisting of various blends or mixtures of premium and anode grade fresh feeds.

The coker fresh feed for all cases of operations, with and without decant oil, on its way to fractionator 2 primary bottoms section, undergo the same operations as previously described for FIG. 1. The pumped coker heater charge material from line 18 is then mixed with hydrogen-rich gas from line 30 and hence, the admixture is fed to soaking pipe 31. The resulting hydrogenated coker heater charge in line 29 from soaking pipe 31 is fed to coker heater 7 and thereafter, becomes an integral part of prior art delayed coking operation. For purposes of clarity, the hydrogenated coker heater charge from line 29, with and without the natural heavy recycle oil, with and without the recycled light gas oil, with and without any diluent, and with and without the blended decant oil, is referred to hereinafter as the "coker heater feed". It is emphasized that if the hydrogen-rich gas in line 30 is not added to the coker heater charge material, the coker heater feed material in line 29 and the coker heater charge material in line 18 are equivalent and can only be considered as one material.

The "coker heater feed" material therefore is a hydrogenated "coker heater charge" material, it is not heated in furnace tubes, and its constituents include unreacted hydrogen and inert gases along with vaporized light hydrocarbons. Whereas, the "coker heater charge" material, as defined in aforementioned discussion of the prior art, is not hydrogenated and contains no gases whatsoever. The extent of hydrogenation, or the efficiency of hydrogenation, or the rate of hydrogen gas consumption or absorption, or the rate at which hydrogen gas is chemically combined with the coker heater charge material, will depend on the most desirable operating ranges of hydrogen partial pressure, heater charge or inlet operating temperature, and the installed fluid residence time for the soaking pipe.

For adequate hydrogenation of the coker heater charge material, the hydrogen partial pressure in soaking pipe 31 can be operated within the range of 200 and 1,200 psig. The high range is desirable, but for compatibility with conventional delayed coking, the inlet hydrogen partial pressure is specified within the range of 200 to 650 psig. This variable is dependent upon the pressure drop in the soaking pipe and heater tubes and therefore limited by the pressure rating requirements of the heater charge hydraulic system.

The other variable necessary for the proper reaction of hydrogen gas is temperature. The most desirable heater charge or inlet operating temperature is within the range of 530° F. and 580° F., but can be extended between 400° F. and 650° F. These are temperature ranges already existing in conventional delayed coking and therefore, impose a limit to the process. It is emphasized that the coker heater feed material from the soaking pipe would have considerably lower temperature than the heater charge or inlet temperature due to overall endothermic type reactions and pipe heat losses to atmosphere. Total drop in temperature can be as much as 50° F. to 250° F., and varies accordingly along the length of the soaking pipe. This continuously declining temperature avoids or minimizes formation of converted asphaltenes in the soaking pipe—a distinctly different and advantageous process than heated tubes within a furnace.

Another variable influencing the rate of hydrogen gas consumption is the installed fluid residence time for soaking pipe 31. Fluid residence time is hereinafter referred to as the quotient from the ratio of the soaking pipe internal volume with the combined volumetric rates of the hydrogen-rich gas and heater charge material, measured at the prevailing average pressure and temperature in the soaking pipe. For a given pipe diameter therefore, longer soaking pipe increases the fluid residence time and also increases the hydrogen gas absorption. Since the hydrogen-rich gas contains inert gases, increased hydrogen-rich gas addition results to higher fluid pressure drop in the soaking pipe and heater tubes.

From the stand point of optimizing the coker yields while improving the products' quality, with and without decant oil blending, the fluid residence time installed for the soaking pipe is specified between 10 and 90 minutes; preferably at 44 minutes, in order to stay within the hydraulic limits already existing in the unit.

The rate of hydrogen-rich gas addition from line 30 is also dependent upon the installed fluid residence time for the soaking pipe. To illustrate, a 30 minutes residence time may require an addition rate of 150 SCF per barrel of heater charge material; whereas, a 15 minutes residence time may require an addition rate of 75 SCF per barrel. The actual rate specifically is determined by the fluid pressure drop through the soaking pipe and heater tubes which can be allowed by heater charge pump 6. Nonetheless, the rate of hydrogen gas addition must always be greater than the rate of hydrogen gas absorption in order to assure adequate hydrogenation of the coker heater charge material. The hydrogen-rich gas addition rate is specified in this invention to be within the range of 30 to 300 SCF per barrel of heater charge material. Purity of the hydrogen-rich gas can be as low as 50%, but a richer concentration is preferred between 70% and 99+%. High purity hydrogen-rich gases, usually available in most refineries, are desirable for low pressure drops in the soaking pipe and heater tubes.

Hydrogenation of the heater charge material below 650° F. is selective to the hydrogen saturation of end-ring polycyclic aromatic structures commonly associated with asphaltenes and medium range polycyclic aromatics. Such hydrogenated aromatic structures, or hydroaromatics, or naphthenic ring structures, are desirably produced between 530° F. and 580° F. Examples of petroleum-based hydrocarbons with naphthenic ring structures which are also highly aromatic and consequently used as feedstocks for premium coke production, are: catalytic cracker decant oil, ethylene tar residue, and shale oil residue. The fact that decant oil blending with the coker fresh feed avoids shot coke formation while natural heavy recycle oil blending does not, bodes well to the principle of improving coke quality by hydrogen transfer from naphthenic ring structures. The natural heavy recycle oil is known to have medium aromatics, but has little or inadequate naphthenic rings in its molecular structure.

If hydrogenation is accomplished under soaking conditions of at least 15 minutes fluid residence time at a continuously increasing temperature, i.e., the heater charge material is being heated in a furnace above 580° F. or up to 730° F., dehydrogenation of the naphthenes and subsequent condensation of aromatic clusters would take place. Unless separated, more converted asphaltenes thus formed in the coker heater feed material would tend to deposit more coke in the heater tubes. Such polymerization reaction is thus distinctly avoided in this new process by the continuously declining fluid temperature. Furthermore, maximum selective hydrogenation of aromatics into more naphthenes or hydroaromatic constituents is assured.

Thermal cracking of petroleum based residues at temperatures above 914° F. produce radicals which are then stabilized by hydrogen from cracked naphthenic rings. These are reactions in the coke drum producing low molecular weight species of medium range aromatics in the liquid phase which act as solvents and in turn, maintain a relatively low viscosity in the carbonizing medium. This then leads to production of polymerized condensed aromatic sheets as precursors for good quality green coke. Similar reaction mechanism can be applied to the minimization of coker heater tube coking tendency. Hydrogen stabilized radicals avoid the precipitation of converted asphaltenes in the tubes and thus, improve the heat transfer coefficient by reducing the viscosity of the rapidly heated fluid. However, excessive vaporization of the fluid in the heater tube due to excessive unreacted hydrogen and inert gases from the hydrogen-rich gas, pushes the reaction to precipitation of converted asphaltenes and therefore, should be avoided.

Good quality green coke is normally associated with end-user properties such as low coefficient of thermal expansion (CTE), high electrical conductivity, and high structural strength; but is more appropriately classified by those skilled in the art in terms of the size of the green coke's optical texture as examined under a microscope. For example, premium coke exhibits >60 micrometer flow domain anisotropy; anode grade coke has 30–60 micrometer coarse flow anisotropy; and fuel grade coke predominantly exists at 0.5–1.5 micrometer fine grained mosaic to 5.0–10.0 micrometer coarse grained mosaic. It may also invariably exhibits some 60 micrometer coarse flow anisotropy. Shot coke is principally fine mosaic, and undesirably produced in prior art delayed coking process if the coker fresh feed has very high asphaltenes content. By the process of hydrogen shuttling reaction mechanism as elucidated in aforementioned discussion, this invention achieves to increase the green coke optical texture size to such an extent that its end-user property is evidently improved. Thus, CTE is reduced in premium coke, electrical conductivity is increased in anode grade coke, and buck-shot-shaped shot cokes are avoided or substantially reduced in fuel grade coke.

In so far as the improvement of hydrocarbons yield is concerned, it is clear that the opening of naphthenic rings produces more straight chain hydrocarbons, and that hydrogen capping of bimolecular radicals reduces its tendency to polymerize into more cokable precursors. Chemically combined hydrogen in the coker heater charge material therefore directly translates into more hydrocarbons yield and less green coke yield. And since the molecular structure of the heater charge material itself is chemically altered, said yield enhancements are additive to, and compatible with other inventions emphasizing upstream and downstream processing improvements requiring no chemical interactions with the coker heater charge material.

Worthy of mention furthermore, is the ability of this invention to substantially reduce shot coke formation while improving the hydrocarbons yield and reducing the green coke yield. The failure of prior art delayed coking process in accomplishing these objectives is primarily attributed to the formation of very viscous carbonizing medium in the green coke melt which is feedstock related, i.e., the coker heater charge material contains very high asphaltenes content with little or no aromatics content, and with very little or insignificant quantity of naphthenic rings in its structures. Formation of shot coke is further aggravated when vapor velocity inside the coke drum is increased by one or combination of the following in order to increase the hydrocarbons yield and reduce the green coke yield: (1), high heater effluent temperature; (2), low coke drum overhead pressure; and (3), partial or total replacement of the natural heavy recycle oil with recycled light gas oil. In the present invention, the viscous carbonizing medium and all its ramifications are altogether minimized by altering the molecular structure of the heater charge material itself. Production of naphthenic ring structures from the coker heater charge by direct non-catalytic hydrogenation is analogous to blending the shot coke forming residue oil with 5 to 15% catalytic cracker decant oil—acknowledged in the art as a sure way of avoiding shot coke.

Construction of soaking pipe 31 is specified as a series of pipes mounted on a vertical position to minimize stratification of the gaseous and liquid phases. Assurance of homogeneous two-phase flow operation in the dispersed flow region, at low fluid velocity and low pressure drop, is assisted by commercially available static mixing elements, rigidly installed internally, and preferably located immediately after each return bend. Without these mixing elements, the pipe diameter is sized for higher fluid velocity and consequently, higher fluid pressure drop.

Soaking pipe 31 may also be located downstream of exhanger 1 or prior to entering fractionator 2. However, aside from achieving a non-optimum operating temperature and uneconomically raising the pressure rating of the series of exchangers represented by exchanger 1, this is not a preferred embodiment for this invention because the gases, consisting of unreacted hydrogen gas and inert gases, are separated in fractionator 2 primary bottoms section. As shown in the preferred embodiment of FIG. 2, gases in the coker heater feed material from line 29 which eventually become part of the coke drum feed from line 20, lower the hydrocarbon partial pressure in the coke drum; thus, promoting vaporization of green coke precursor hydrocarbons. It is emphasized however that the present invention applies to the case of the prior art's configuration where the natural heavy recycle oil is pumped to another unit and the coker fresh feed from line 13 is used as the coker heater charge material.

Hydrogenation of the heater charge material is not limited to a soaking pipe either. A vessel with equivalent fluid residence time is just as effective, but desirable results may be unpredictable. Such a vessel for this configuration can be fitted internally with a center-mounted tower packing type fluid dispersing structure wherein the heater charge material mixes and aspirates upward with the hydrogen-rich gas for a specified once-through fluid residence time of approximately 15 minutes. This residence time can be increased by allowing the liquid therein to recirculate in the vessel and said structure. Increased circulation can be induced by increasing the aspirating gas rate which in turn, is accomplished by an external recirculating hydrogen-rich gas compressor. This compressor takes the separated used-up gases from the top of the vessel and compresses back into said internal structure along with the fresh make-up hydrogen-rich gas. The coker heater feed liquid, thoroughly hydrogenated, leaves the vessel and hence fed to the coker heater along with the used-up gases from the top of the vessel.

A simpler but less effective configuration is a large vessel fitted with a commercial high-shear type mechanical mixer or agitator capable of dispersing the hydrogen-rich gas into the coker heater charge material.

Referring back to the drawing of the preferred embodiment in FIG. 2, the hydrogenated coker heater feed liquid in combination with unreacted hydrogen gas, vaporized light hydrocarbons and inert gases, i.e., the coker heater feed material from line 29, is fed into the heating tubes of coker heater 7. Said feed material is rapidly heated to approximately 920° F. within 10 minutes and the resulting coker heater effluent from line 19 is fed into one of coke drums 9 or 10 for coking reactions and production of gases, hydrocarbons, and green coke.

Aside from aforementioned differences in cracking and polymerization reactions within the heater and the coke drum, the operational steps and routing of processed materials from coke drums 9 or 10 and thereafter, to fractionator 2 and heater charge pump 6, are similar to prior art delayed coking process.

EXAMPLE

The following Example further illustrates the basic principle of, but does not limit the present invention.

TABLE 1

Non-catalytic Hydrogenation of Vacuum Tower Bottoms Residue Oil

| | Original VTB Oil | No. 1 Run Treated Oil | No. 2 Run Treated Oil |
|---|---|---|---|
| API Gravity | 4.5 | 4.2 | 4.2 |
| Specific Gravity @ 60/60 °F. | 1.0403 | 1.0426 | 1.0426 |
| Wt % Conradson Carbon Residue | 23.1 | 13.6 | 13.4 |
| Wt % Asphaltenes (heptane insol.) | 14.0 | 14.0 | 13.4 |
| Wt % Asphaltenes (pentane insol.) | 23.52 | 23.45 | 23.67 |
| Viscosity, cStokes @ 300 °F. | 564.6 | 544.9 | 549.0 |
| Viscosity, cStokes @ 350 °F. | 166.2 | 164.3 | 165.1 |
| Softening Point, °F. | 141.0 | 141.0 | 140.0 |
| Wt % Carbon (C) Content | 85.36 | 84.90 | 85.03 |
| Wt % Hydrogen (H) Content | 9.52 | 9.21 | 9.42 |
| Carbon/hydrogen (C/H), Wt. ratio | 8.97 | 9.22 | 9.03 |

The data presented in Table 1 were obtained from a benchscale, batch reactor comprising of an insulated 3.75 inches OD and approximately 16 inches long stainless steel container of 1,993.6 mL empty volume capacity equipped with an electric heating element, pressure gauge, temperature indicator-controller and a shaking device which tilts the reactor assembly back and forth by about 45 degrees from its horizontal position at any desired speed.

There was used 467.2 mL sample of residue oil from a refinery vacuum distillation tower bottoms with properties as presented in Table 1, under the heading "Original VTB Oil", charged to said reactor and then pressured with 200 psig hydrogen gas at 130° F. The stratified mixture from an initial temperature of 130° F. was then heated to 400° F. at corresponding pressure of 300 psig for 35 minutes and then to 567° F. at corresponding pressure of 350 psig for 20 minutes. To evenly distribute heat into the stratified mixture, the reactor assembly was then shaken for 2 minutes. This procedure dropped the temperature and pressure to about 462° F. and 310 psig, respectively. Heat was then continued, while the reactor assembly was being shaken, to 523° F. and 330 psig for 17 minutes. After which, the heating element was turned-off while vigorously shaking the reactor for 27 minutes. Consequently, the pressure and temperature of the reacted mixture at the end of this reaction period dropped to 300 psig and 440° F., respectively. Finally, the reaction was terminated when the reactor pressure was reduced to zero by releasing the unreacted hydrogen gas and light hydrocarbon vapors to atmosphere and allowing the reactor assembly to cool down to a pourable temperature of approximately 250° F. Thus, the properties of the hydrogenated liquid oil for this run is shown in Table 1 under the heading "No. 1 Run Treated Oil".

In the following run, 738.2 mL sample from the same original residue oil was used and charged to said reactor. It was then pressured with 200 psig hydrogen gas at 93° F. The stratified mixture from an initial temperature of 93° F. was then heated to 250° F. without shaking the reactor assembly for 21 minutes and thus, raised the hydrogen gas pressure to 268 psig. To evenly distribute heat into the stratified mixture, the reactor assembly was then very slowly shaken for 41 minutes thereby raising the temperature and pressure to 400° F. and 317 psig, respectively. Heat was then continued for 13 minutes without shaking the reactor to 505° F. at a corresponding pressure of 340 psig. Slow shaking of the reactor assembly was then resumed for 38 minutes while heat was continued. This procedure subsequently raised the temperature to 570° F. at corresponding pressure of 372 psig. After which, the heating element was turned-off while vigorously shaking the reactor for 60 minutes. Consequently, the pressure and temperature of the reacted mixture at the end of this reaction period dropped to 290 psig and 394° F., respectively. Finally, the reaction was terminated when the reactor pressure was reduced to zero by releasing the unreacted hydrogen gas and light hydrocarbon vapors to atmosphere and allowing the reactor assembly to cool down to a pourable temperature of approximately 250° F. Thus, the properties of the hydrogenated liquid oil for this run is shown in Table 1 under the heading "No. 2 Run Treated Oil".

In order to prove the effect of fluid residence time in hydrogenation, aforementioned second run was repeated, but the heat-up period between the temperature of 400° F. and 515° F. and then the cool down period to 485° F. were limited to 21 minutes and 9 minutes, respectively. The corresponding Conradson Carbon Residue (CCR) content obtained from this procedure was 20.6 weight %. At this point, it is emphasized, as is known to those who practice the art, that the CCR content of hydrocarbon materials is an indication of its tendency to polymerize into coke. In fuel and anode grade coke manufacturing, it is thus common practice to correlate weight % CCR content with weight % coke yield. Furthermore, the almost identical % CCR of the treated oils in Table 1 indicated maximum hydrogenation of the aromatic structures. Additional fluid residence time is therefore not necessary once an optimum hydrogenation has been reached.

From Table 1, aforementioned procedures show that hydrogenated oils from Run No. 1 and Run No. 2 are less viscous and somewhat denser—indicating a somewhat more aromatic content than the original VTB oil. Since the pentane and heptane insolubles are virtually unchanged, it is evident that additional heavy gas oil have not been formed and that polycondensation of aromatics in this invention is minimized or altogether avoided. Again it is emphasized, this is possible only because of the continuously declining operating temperature when the heat was turned-off during reaction. Furthermore, since significantly lower carbon residue content are obtained from the hydrotreated oils, the results indicated a hydrogen transfer reaction mechanism to the double bonds of polycondensed aromatics, i.e., the formation of more hydroaromatic or naphthenic-aromatic clusters. The higher C/H content in the treated oils indicated that hydrogen induced thermal cracking reactions of straight chain hydrocarbons attached to the aromatic clusters via an aryl—or alkyl bridge is possible even at temperatures lower than 650° F. The radicals thus formed induce hydrogen capping of straight chain hydrocarbons and absorption of hydrogen in aromatic double bonds. In the absence of hydrogen, such reaction mechanism is not possible.

Aforementioned hydrogenation results, as elucidated in this specification, bode well to significant reduction in coke yield and improvement in hydrocarbons yield. The following experimentation illustrate as well the significance of said hydrogen transfer reaction mechanism to the present invention in improving the products' quality.

Destructive distillation of heavy hydrocarbons from residue oil is analogous to coking. The procedures for conradson carbon residue content determination is in fact a severe example of destructive distillation. When samples of heavy hydrocarbons are subjected to high temperatures and considerable soaking time, rearrangement of the original molecular structure into their products coke, liquid distillates and gases, along with differences in the distillates' product quality, and characteristics, as well as difference in the gaseous products distribution, is a manifestation of the difference in their original molecular structure.

The original VTB oil and No. 1 Run Treated Oil of this Example were therefore subjected to destructive distillation at atmospheric pressure and approximately 740° F. apparent initial cracking temperature to about 900° F. maximum coking mass temperature for about 2½ hours of total heating time in a generally known ASTM D1160 distillation apparatus.

TABLE 2

Product Properties from Destructive Distillation

| | Original VTB Oil | No. 1 Run Treated Oil |
|---|---|---|
| Gas Analysis, Weight %: | | |
| Hydrogen | 7.40 | 1.98 |
| Hydrogen Sulfide | 14.18 | 11.87 |
| Methane | 42.77 | 43.48 |
| Ethylene | 1.61 | 2.33 |
| Ethane | 16.01 | 19.32 |
| Propylene & Propane | 12.77 | 15.30 |
| Butane | 2.25 | 2.61 |
| Isobutane | 0.72 | 0.73 |
| Butylenes | 2.29 | 2.38 |
| Total Weight % | 100.00 | 100.00 |
| $C_5$+, Distillate Properties: | | |
| Gasoline Cut | | |
| ASTM D-86 Range, °F. | 104–160 | - |
| TBP Range, °F.* | 63–160 | |
| LV % Distilled | 3.31 | 0.00 |
| Wt % Distilled | 2.48 | 0.00 |
| °API | 93.8 | |
| Watson K* | 13.0 | |
| Molecular Weight* | 84.0 | |
| Wt % Sulfur | 0.1635 | |
| Naphtha Cut | | |
| ASTM D-86 Range, °F. | 160–360 | 165–360 |
| TBP Range, °F.* | 160–360 | 120–360 |
| LV % Distilled | 16.39 | 20.62 |
| Wt % Distilled | 14.39 | 17.94 |
| °API | 61.0 | 64.2 |
| Watson K* | 12.1 | 12.4 |
| Molecular Weight* | 116. | 112. |
| Wt % Sulfur | 0.74 | 0.87 |
| Light Gas Oil Cut | | |
| ASTM D-86 Range, °F. | 360–650 | 360–650 |
| TBP Range, °F.* | 360–650 | 360–650 |
| LV % Distilled | 45.82 | 50.43 |
| Wt % Distilled | 47.17 | 50.78 |
| °API | 32.6 | 37.6 |
| Watson K* | 11.4 | 11.7 |
| Molecular Weight* | 200. | 232. |
| Heavy Gas Oil Cut | | |
| ASTM D-86 Range, °F. | 650+ | 650+ |
| TBP Range, °F.* | 650+ | 650+ |
| LV % Distilled | 34.48 | 28.95 |
| Wt % Distilled | 35.96 | 31.28 |
| °API | 30.6 | 26.1 |
| Watson K* | 12.0 | 11.7 |
| Molecular Weight* | 328. | 318. |
| Wt % CCR | 0.80 | 0.15 |

*Properties estimated from generally accepted engineering correlations.

The results of such experimentation to liquid and gaseous products properties are presented in Table 2. Prominent improvements in gases and $C_5$+ hydrocarbons properties with commercial implications are also noted hereunder.

Hydrogen gas production is considerably lower from the No. 1 Run oil and has more constituents with greater molecular weights than the original oil. Propane, propylene and butanes gases have higher market value and its recoveries in the coker gas plant unit are considerably higher than ethane, ethylene and methane gases. Another advantage is lower volumetric capacity for the gas plant.

There are no significant differences in the light $C_5+$ cuts, but the light gas oil cut has more yield from the treated oil than the original feedstock. Its density is also lighter and more paraffinic. The heavy gas oil cut from the treated oil has less yield, but heavier in density and more paraffinic than the original oil. Its lower CCR content implies that the TBP end point of the heavy gas oil cut can be higher, or that the natural heavy recycle oil rate can be lower from the treated oil than the original oil and still meet the requirements of downstream hydroprocessing.

Although the preferred embodiment of the invention has been described above, it is to be understood that modifications can be made therein and thereto without departing from the spirit and scope of the invention. All such modifications are intended to be included within the scope of the present invention, which is to be limited only by the claims which follow.

I claim:

1. In a delayed coking process comprising of a coker fractionator, coker heater and coke drums wherein a coker fresh feed consisting of petroleum hydrocarbon derivatives from various refining processes is thermally processed in said heater and coke drums producing green coke, hydrocarbons and gases, the improvement comprising adding hydrogen-rich gas in the absence of a catalyst to the coker heater charge material in a soaking pipe with a fluid residence time in the range of about 10 to 90 minutes in an amount in the range of about 30 to 300 SCF per barrel of the heater charge material under an inlet hydrogen partial pressure in the range of about 200 to 650 psig from an inlet operating temperature in the range of about 400° F. to 650° F. to an outlet operating temperature in the range of about 50° F. to 250° F. cooler than said inlet operating temperature range to minimize a formation of converted asphaltenes and feeding the coker heater feed material thus hydrogenated directly into said coker heater without separating any constituents from said heater feed material thereby improving the quality and yields of products from the process.

2. The process of claim 1 wherein said soaking pipe is a series of pipes mounted on a vertical position with internally mounted static mixing elements located immediately after each return bend thereby minimizing stratification of the gaseous and liquid phases and assuring homogeneous two-phase flow operation at low fluid velocity and low fluid pressure drop.

3. The process of claim 1 wherein said petroleum hydrocarbon derivatives from various refining processes is selected from the group consisting of vacuum distillation residue oil, atmospheric reduced crude oil, asphalt, heavy fuel oil, tar sand bitumen and mixture thereof producing green coke suitable for fuel grade coke and aluminum anode grade coke.

4. The process of claim 3 wherein 0.5 to 4.4 volume % catalytic cracker decant oil is blended to said petroleum hydrocarbon derivatives thereby reducing substantially the shot coke formed with said green coke.

5. The process of claim 1 wherein premium stocks selected from the group consisting of catalytic cracker decant oil, thermal tar residue, coal tar residue, ethylene tar residue, shale oil residue and mixture thereof is blended with said petroleum hydrocarbon derivatives of low heteroatoms content consisting of vacuum distillation residue oil, atmospheric reduced crude oil, heavy fuel oil and mixture thereof thereby producing premium grade coke from lower quality admixes of coker fresh feeds.

* * * * *